US006676581B1

(12) United States Patent
Lin

(10) Patent No.: US 6,676,581 B1
(45) Date of Patent: Jan. 13, 2004

(54) STRETCHING DEVICE FOR FURNITURE

(76) Inventor: Cheng Hsien Lin, No. 22, Lane 511, Sec. 1, Nan Hsiung Rd., Kuan Miao Hsiang (TW)

( * ) Notice: Subject to any disclaimer, the term of this patent is extended or adjusted under 35 U.S.C. 154(b) by 15 days.

(21) Appl. No.: 10/195,442

(22) Filed: Jul. 15, 2002

(51) Int. Cl.[7] ..... A63B 71/00
(52) U.S. Cl. ..... 482/148; 482/904; 297/353
(58) Field of Search ..... 482/148, 904; 297/391, 285, 296, 61, 353, 411.41, 411.36

(56) References Cited

U.S. PATENT DOCUMENTS 5,425,566 A * 6/1995 Buchacz ..... 297/301
5,918,940 A * 7/1999 Wakamatsu et al. ..... 297/410
6,354,664 B1 * 3/2002 Chen ..... 297/353
6,565,155 B1 * 5/2003 Huang ..... 297/353

* cited by examiner

*Primary Examiner*—Nicholas D. Lucchesi
*Assistant Examiner*—L Amerson
(74) *Attorney, Agent, or Firm*—Charles E. Baxley

(57) ABSTRACT

A stretching device is mounted to a positioning portion of furniture and includes a motor, a telescopic rod, and a handlebar. The motor is activatable for moving the telescopic rod in a retracting or extending direction. The telescopic rod is located in a position corresponding to a backrest of the furniture and includes an upper end fixed to the handlebar to move therewith. The handlebar is located on top of the furniture and includes a pair of grips. The handlebar further includes at least one button for controlling turning directions of the motor. When a user sits or lies in the furniture with two hands grasping the grips, a body of the user is stretched when the button is pushed to cause the motor to turn in a direction for moving the telescopic rod in the extending direction.

4 Claims, 6 Drawing Sheets

STRETCHING DEVICE FOR FURNITURE

BACKGROUND OF THE INVENTION

1. Field of the Invention

The present invention relates to a stretching device for furniture such as a chair or bed, allowing stretching of the spine of the user sitting or lying on the furniture.

2. Description of the Related Art

Chairs and beds are the most frequently used furniture in our lives, providing a place for sitting or lying. However, the user would feel uncomfortable in the spinal area after sitting or lying for a period of time. The user has to move his or her body for relieving this discomfort, yet the user's movement is hindered by the bed or chair. Thus, the user has to get down from the bed or chair. Further, ordinary body movement cannot stretch the spine of the user to a proper extent. It is, therefore, a need in a stretching device for furniture that allows stretching of the spine and the back of the user without getting down from the bed or chair.

SUMMARY OF THE INVENTION

An object of the present invention is to provide a stretching device for furniture that allows stretching of the spine of the user without getting down from the bed or chair.

In accordance with the present invention, a combination of furniture and a stretching device is provided. The furniture comprises a backrest and a positioning portion. The stretching device is mounted to the positioning portion of the furniture and includes a motor, a telescopic rod, and a handlebar. The motor is activatable for moving the telescopic rod in a retracting or extending direction. The telescopic rod is located in a position corresponding to the backrest of the furniture and includes an upper end fixed to the handlebar to move therewith. The handlebar is located on top of the furniture and includes a pair of grips. The handlebar further includes at least one button for controlling turning directions of the motor.

When a user sits or lies in the furniture with two hands grasping the grips, a body of the user is stretched when the button is pushed to cause the motor to turn in a direction for moving the telescopic rod in the extending direction.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
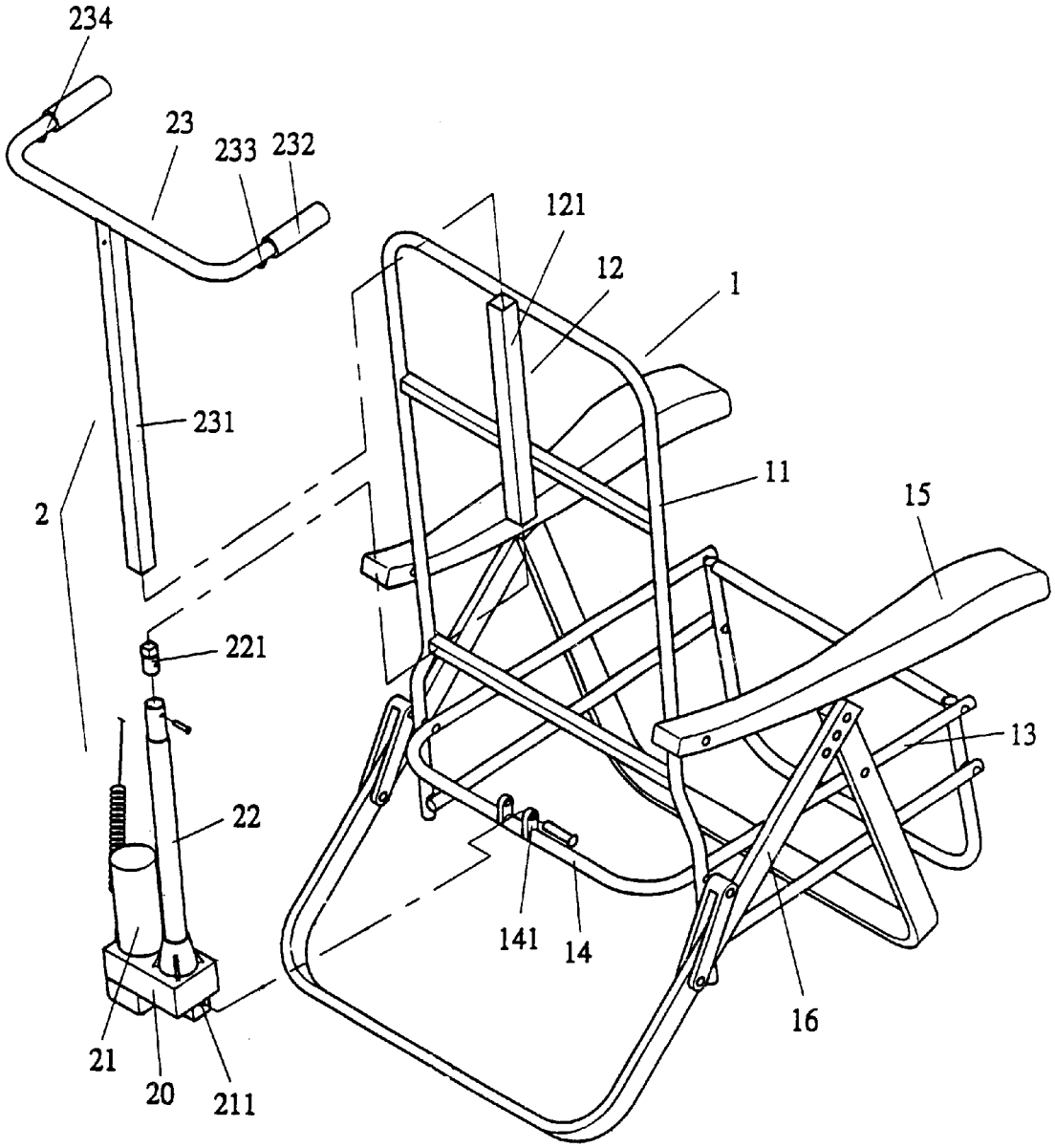
FIG. 1 is a perspective view, partly exploded, of a chair with a stretching device in accordance with the present invention.
Figure 2:
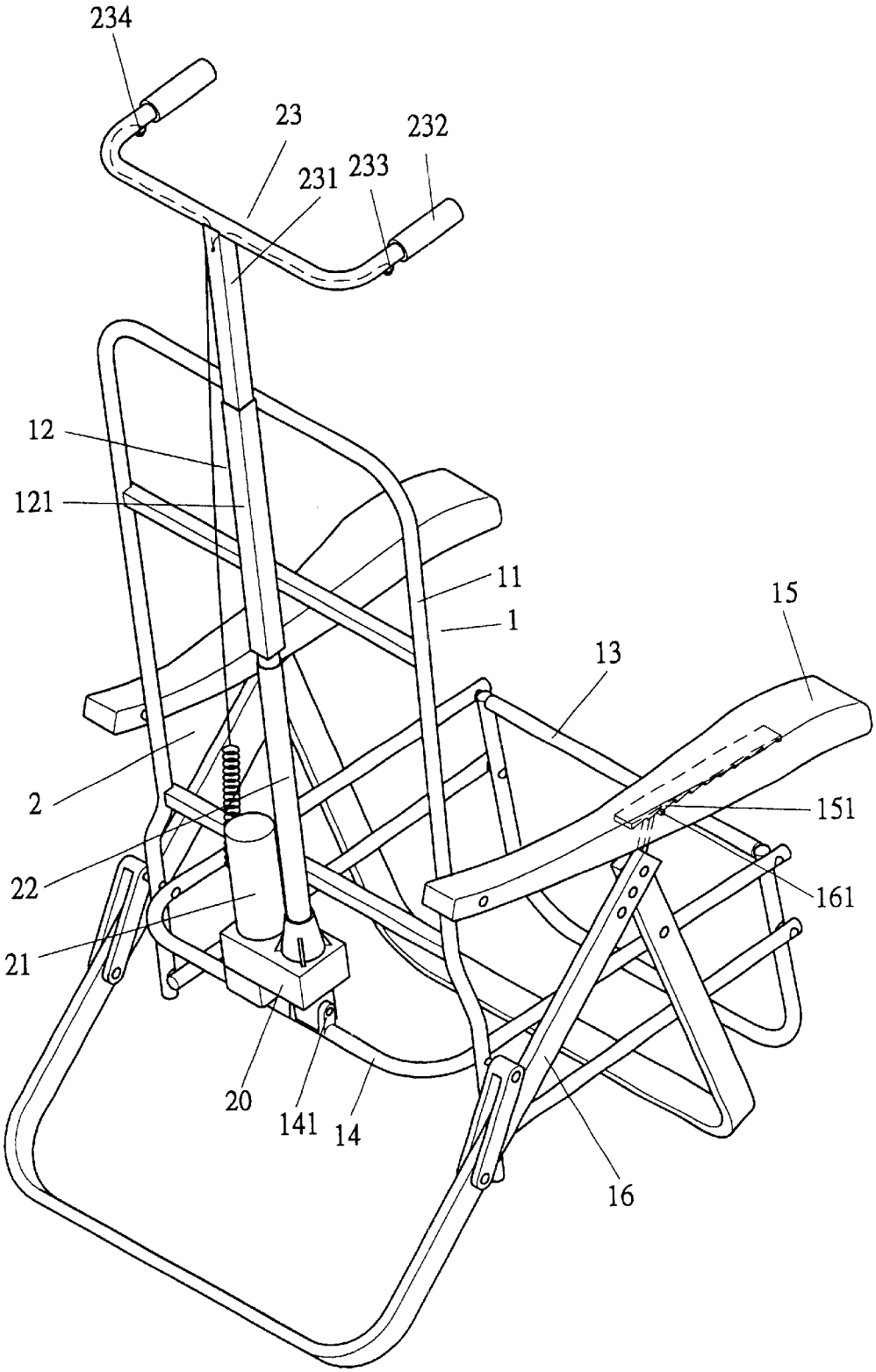
FIG. 2 is a perspective view of the chair with the stretching device in accordance with the present invention.

Referring to FIGS. 1 and 2, the present invention provides a stretching device 2 to be used with furniture such as a chair or bed. In this embodiment, the chair 1 includes a backrest 11 having a positioning portion 12 in the form of a rectangular tube. The chair 1 further includes a seat frame 13 having a connecting portion 14 with pivot holes 141 for pivotal connection with an engaging member 211 on a motor base 20 of the stretching device 2. The chair 1 further includes two armrests 15 each having a number of positioning grooves 151 for selectively engaging with a positioning block 161 on an associated leg support 16, thereby allowing adjustment in an inclination angle of the backrest 1. Thus, the user may sit or lie in the chair 1.

The stretching device 2 includes a motor 21 and a telescopic rod 22 mounted on the motor base 20 that is pivotally connected to the connecting portion 14 of the seat frame 13. The motor 21 can be activated to move the telescopic rod 22 in a retracting direction or extending direction. The stretching device 2 further includes a handlebar 23 located on top of the chair 1. The handlebar 23 includes a vertical connecting rod 231 and a substantially U-shaped member (not labeled) fixed to an upper end of the connecting rod 231, the U-shaped member having a pair of grips 232 on two ends thereof. The connecting rod 231 is rectangular and slidably received in the guide tube 121, thereby allowing vertical movement of the connecting rod 231 and preventing rotational movement of the connecting rod 231. A lower end of the connecting rod 231 is fixed to an upper end of the telescopic rod 22 by an engaging member 221. A button 233, 234 is provided on the U-shaped member in a position adjacent to an associated handgrip 232. The buttons 233 and 234 are electrically connected to the motor 21 for activating the motor 21 to turn in opposite directions. For example, push of button 233 causes the motor 21 to turn in a direction, and push of the other button 234 causes the motor 21 to turn in a reverse direction.

Figure 3:
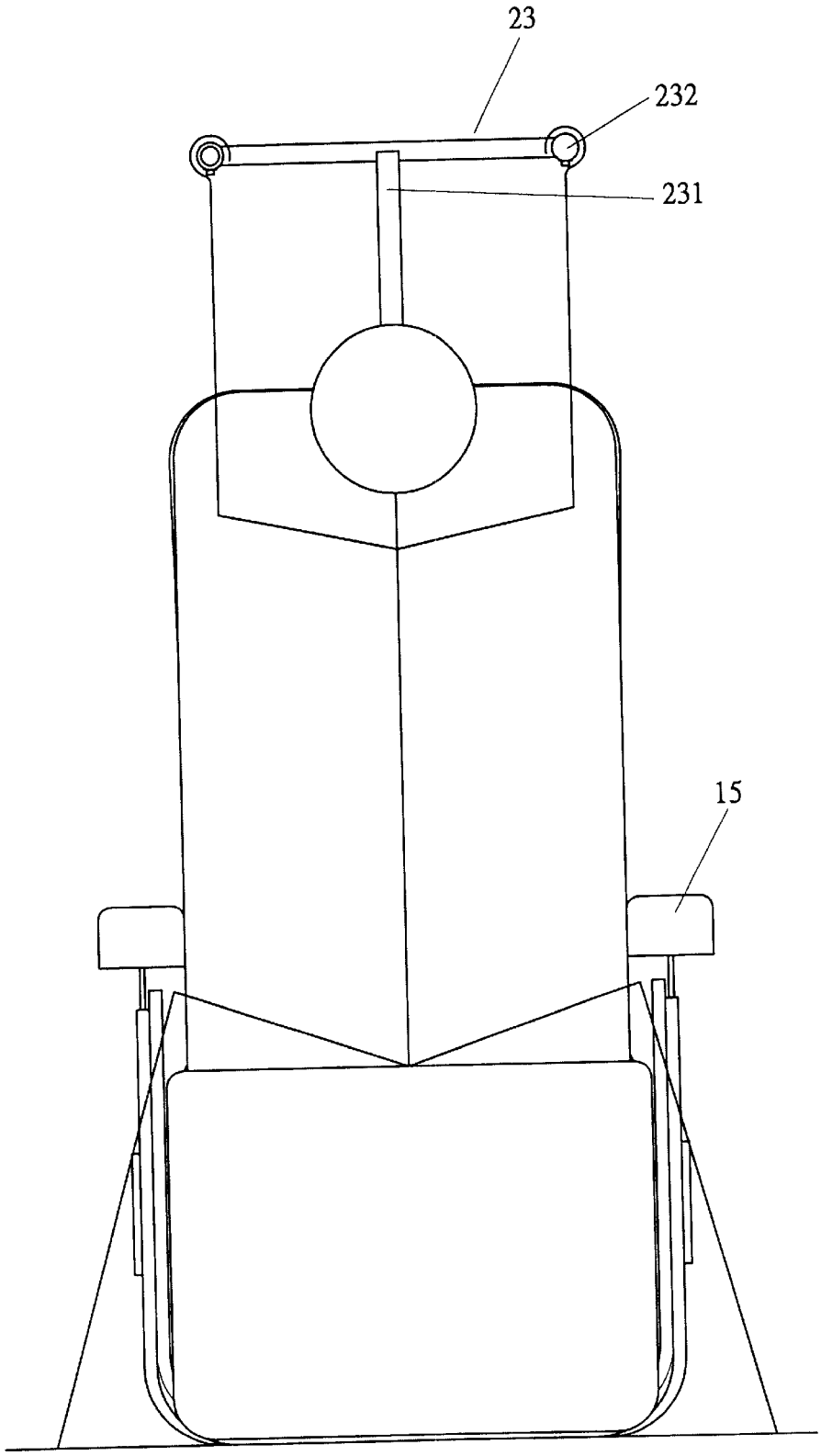
FIG. 3 is a schematic front view illustrating use of the chair.
Figure 4:
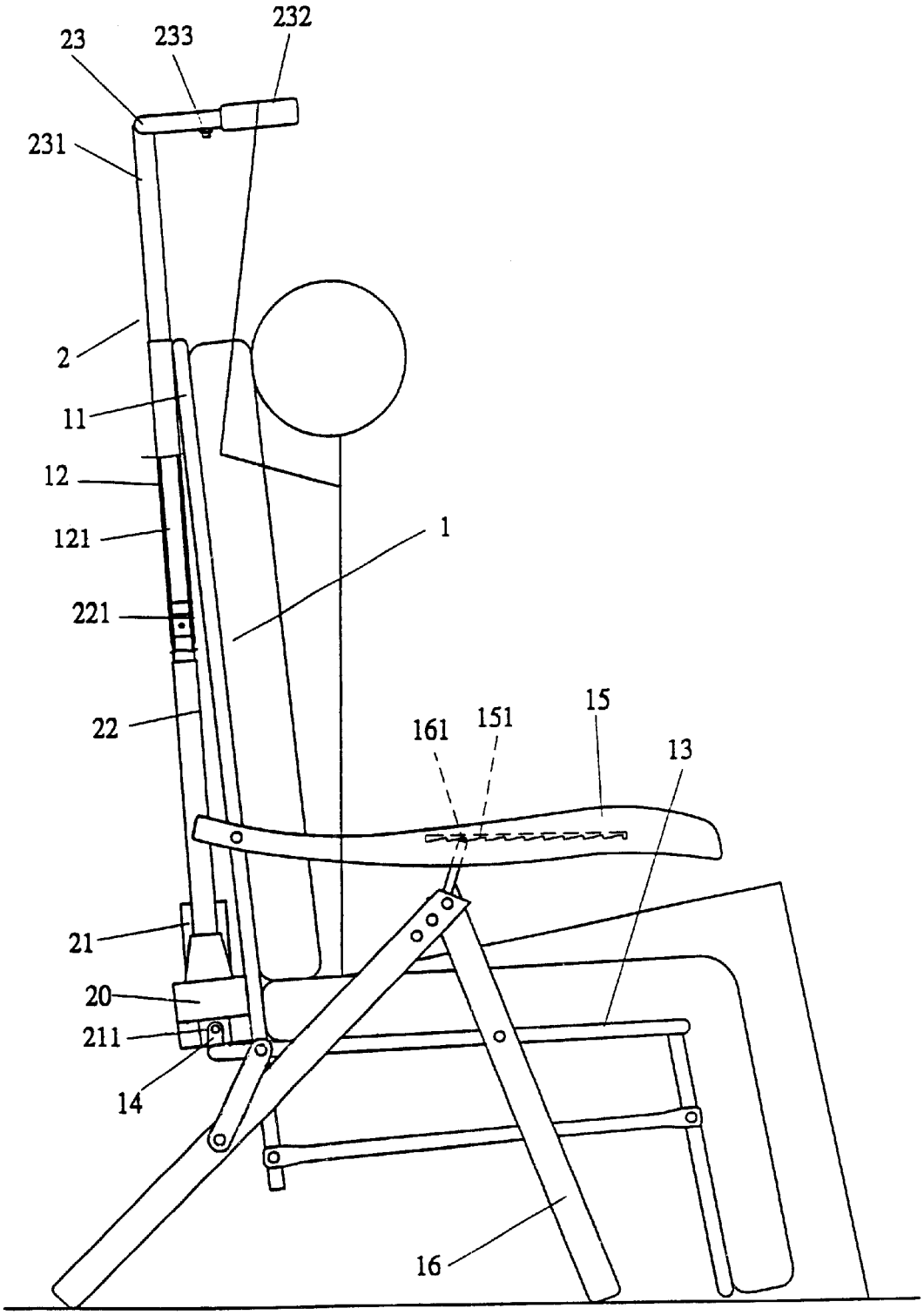
FIG. 4 is a schematic side view illustrating use of the chair.
Figure 5:
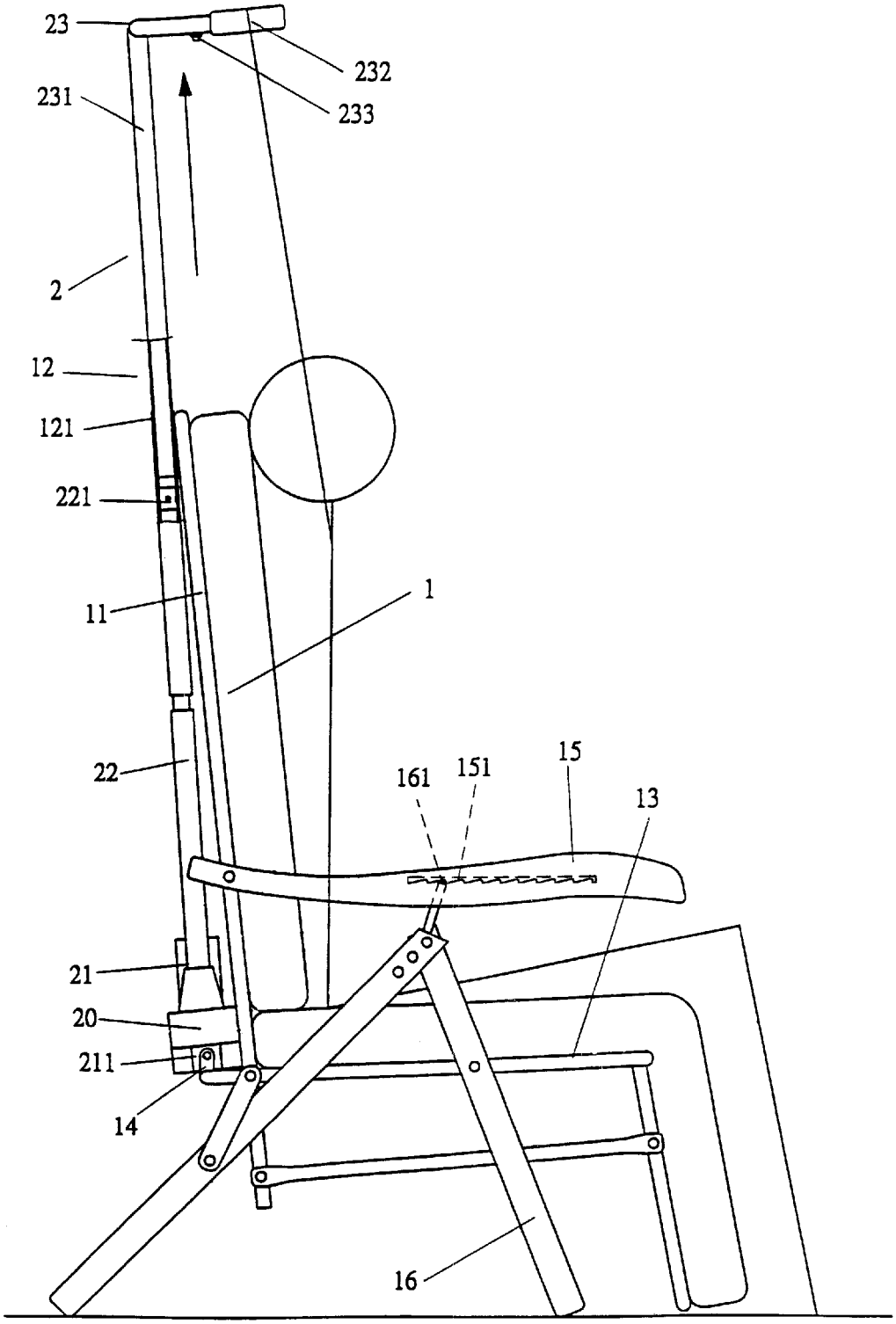
FIG. 5 is a schematic side view similar to FIG. 4, illustrating stretching of the spine of the user.

Referring to FIGS. 3 through 5, when in use, the user may grasp the grips 232 and push one of the buttons, e.g., button 233 to cause the motor 21 to turn in a direction for moving the telescopic rod 22 in the extending direction, best shown in FIG. 5. Thus, the spine and the back of the user may be stretched while the user is still sitting in the chair 1. The user may then push the other button 234 to move the telescopic rod 22 in the retracting direction.

Figure 6:
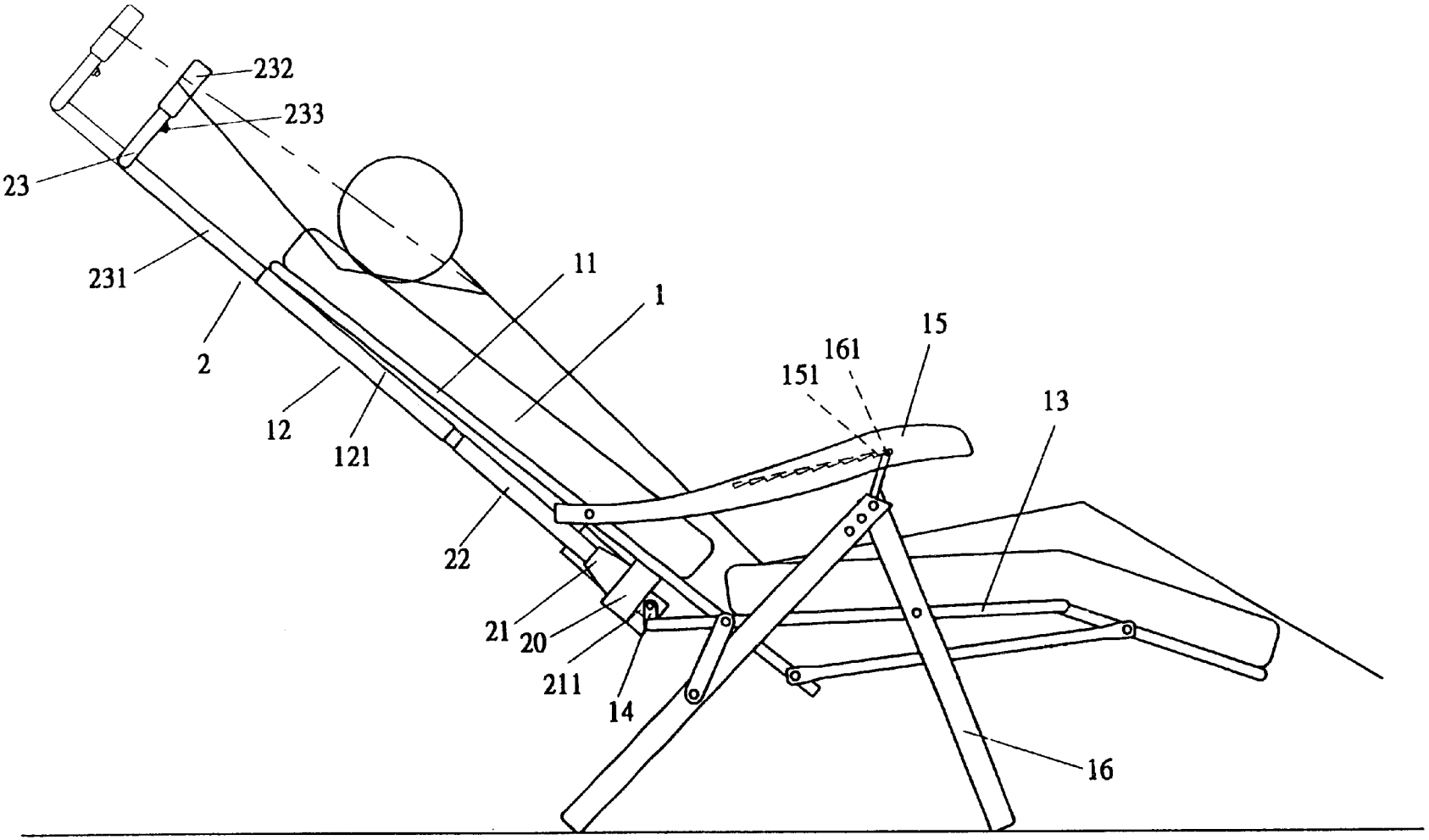
FIG. 6 is a schematic view similar to FIG. 5, illustrating stretching of the spine of the user while the backrest of the chair is in an inclined position.

FIG. 6 illustrates use of the stretching device 2 while the backrest 11 of the chair 1 is in an inclined position. Namely, the user may grasp the grips 232 and push one of the buttons, e.g., button 233 to cause the motor 21 to turn in a direction for moving the telescopic rod 22 in the extending direction, best shown in FIG. 6. Thus, the spine and the back of the user may be stretched while the user is still sitting in the chair 1. The user may then push the other button 234 to move the telescopic rod 22 in the retracting direction.

According to the above description, it is appreciated that the stretching device 2 in accordance with the present invention allows stretching of the spine and the back of the user while the user is still sitting in the furniture such as a chair or bed regardless of the inclination angle of the furniture.

Although the invention has been explained in relation to its preferred embodiment, it is to be understood that many other possible modifications and variations can be made without departing from the scope of the invention as hereinafter claimed.

What is claimed is:

1. A combination of furniture and a stretching device, the combination comprising:

furniture comprising a backrest and a positioning portion; and a stretching device mounted to the positioning portion of the furniture and including a motor, a telescopic rod, and a handlebar, the motor being activatable for moving the telescopic rod in a retracting or extending direction, the telescopic rod being located in a position corresponding to the backrest of the furniture and including an upper end fixed to the handlebar to move therewith, the handlebar being located on top of the furniture and including a pair of grips, the handlebar further including at least one button for controlling turning directions of the motor;

wherein when a user sits or lies in the furniture with two hands grasping the grips, a body of the user is stretched when said at least one button is pushed to cause the motor to turn in a direction for moving the telescopic rod in the extending direction.

2. The combination as claimed in claim 1, wherein the stretching device further includes a motor base on which the motor and the telescopic rod are mounted, the furniture includes a connecting portion for pivotal connection with the motor base.

3. The combination as claimed in claim 2, wherein the furniture includes a guide tube, the handlebar including a vertical connecting rod having a lower end fixed to an upper end of the telescopic rod, the guide tube allowing vertical sliding movement of the vertical connecting rod and preventing rotational movement of the vertical connecting rod.

4. The combination as claimed in claim 1, wherein the handlebar includes two buttons respectively adjacent to the grips for controlling turning of the motor in opposite directions, thereby controlling retracting and extending movement of the telescopic rod.

* * * * *